US007801317B2

(12) United States Patent
Kim

(10) Patent No.: US 7,801,317 B2
(45) Date of Patent: Sep. 21, 2010

(54) APPARATUS AND METHOD OF REPRODUCING WIDE STEREO SOUND

(75) Inventor: Sun-min Kim, Suwon-si (KR)

(73) Assignee: Samsung Electronics Co., Ltd, Suwon-si (KR)

( * ) Notice: Subject to any disclaimer, the term of this patent is extended or adjusted under 35 U.S.C. 154(b) by 1595 days.

(21) Appl. No.: 11/076,001

(22) Filed: Mar. 10, 2005

(65) Prior Publication Data

US 2005/0271213 A1 Dec. 8, 2005

Related U.S. Application Data

(60) Provisional application No. 60/576,618, filed on Jun. 4, 2004, provisional application No. 60/578,860, filed on Jun. 14, 2004.

(30) Foreign Application Priority Data

Jun. 11, 2004 (KR) ..... 10-2004-0043077

(51) Int. Cl.
*H04R 5/02* (2006.01)

(52) U.S. Cl. ..... 381/303; 381/1; 381/17

(58) Field of Classification Search ..... 381/310, 381/1, 17, 18, 10, 300, 19, 61, 303
See application file for complete search history.

(56) References Cited

U.S. PATENT DOCUMENTS 4,192,969 A * 3/1980 Iwahara ..... 381/1
4,219,696 A 8/1980 Kogure et al.
4,388,494 A 6/1983 Schone et al.
5,173,944 A 12/1992 Begault
5,727,066 A * 3/1998 Elliott et al. ..... 381/1
6,067,361 A 5/2000 Kohut et al.
6,243,476 B1 * 6/2001 Gardner ..... 381/303
6,442,277 B1 * 8/2002 Lueck et al. ..... 381/17
6,498,857 B1 * 12/2002 Sibbald ..... 381/310

(Continued)

FOREIGN PATENT DOCUMENTS

JP 52-2402 1/1977

(Continued)

OTHER PUBLICATIONS

International Search Report issued on Aug. 31, 2005, for PCT/KR2005/001559.

(Continued)

*Primary Examiner*—Vivian Chin
*Assistant Examiner*—Jason R Kurr
(74) *Attorney, Agent, or Firm*—Stanzione & Kim LLP

(57) ABSTRACT

An apparatus and a method of reproducing a wide stereo sound by widening a stereo sound output by an audio reproducing apparatus using only two closely disposed channel speakers include a widening filtering operation and a direct filtering operation. In the widening filtering operation, virtual sound sources for arbitrary locations are formed from a stereo-channel audio signal using head related transfer functions measured at predetermined locations, and crosstalk is cancelled from the virtual sound sources using filter coefficients in which the head related transfer functions are reflected. In the direct filtering operation, signal characteristics of the stereo-channel audio signal are adjusted based on the crosstalk-cancelled virtual sound sources.

11 Claims, 5 Drawing Sheets

U.S. PATENT DOCUMENTS

| | | | | |
|---|---|---|---|---|
| 2005/0265558 | A1* | 12/2005 | Neoran | 381/17 |
| 2005/0271214 | A1 | 12/2005 | Kim | |

FOREIGN PATENT DOCUMENTS

| | | |
|---|---|---|
| JP | 54-42102 | 4/1979 |
| JP | 05-244699 | 9/1993 |
| JP | 09-327099 | 12/1997 |
| JP | 10-070797 | 3/1998 |
| JP | 11-252698 | 9/1999 |
| JP | 2000-333297 | 11/2000 |
| KR | 1998-31979 | 7/1998 |
| KR | 10-0272575 | 11/2000 |
| WO | WO 89/03632 | 4/1989 |
| WO | WO 98/20707 | 5/1998 |

OTHER PUBLICATIONS

Korean Office Action dated Feb. 10, 2006 of Korean Patent Application No. 2004-43077.

* cited by examiner

APPARATUS AND METHOD OF REPRODUCING WIDE STEREO SOUND

CROSS-REFERENCE TO RELATED APPLICATIONS

This application claims the benefit under 35 U.S.C. §119 of Korean Patent Application No. 2004-43077, filed on Jun. 11, 2004, in the Korean Intellectual Property Office, and U.S. Provisional Patent Application Nos. 60/576,618 and 60/578,860, filed on Jun. 4, 2004 and Jun. 14, 2004, respectively, in the U.S. Patent and Trademark Office, the disclosures of which are incorporated herein in their entirety by reference.

BACKGROUND OF THE INVENTION

1. Field of the Invention

The present general inventive concept relates to an audio reproduction system, and more particularly, to a method and an apparatus to reproduce a wide stereo sound by widening a stereo sound output by an audio reproducing apparatus using only speakers of two channels that are disposed close to each other.

2. Description of the Related Art

Since televisions generally include speakers of two channels attached to either the right and the left or the bottom of a main body, a hearing angle is narrow. Hence, a stereo effect generated by DVD/CD reproducers or a television broadcast is reduced, and stereo sounds are heard like mono sounds. In particular, a narrow stereo sound stage reduces the sound quality of a movie and can cause movie viewers to purchase extra speaker systems.

Conventional stereo enhancement systems enhance stereo sounds in front of a listener using only two speakers.

A conventional stereo enhancement system is disclosed in U.S. Pat. No. 6,597,791 (filed on Dec. 15, 1998), entitled "Audio Enhancement System."

Referring to U.S. Pat. No. 6,597,791, the conventional stereo enhancement system processes a difference signal generated from left and right input signals to create a stereo sound. The difference signal is processed through equalization characterized by amplification of auditory frequencies of high and low bands. The processed difference signal is combined with a sum signal, generated from the left and right input signals, and the original left and right input signals.

However, most conventional stereo enhancement systems have difficulties in designing a crosstalk cancellation filter, so they either use a sum of right and left channels of a stereo sound and a difference between the right and left channels or adjust a phase of and an amplitude of the stereo sound, instead of using a head related transfer function (HRTF). The non-use of HRTFs reduces the amount of calculation required by the conventional stereo enhancement systems, so the conventional stereo enhancement systems can be easily implemented. However, the conventional stereo enhancement systems do not have excellent performances because they are designed without consideration of a head and an auricle of a human being.

SUMMARY OF THE INVENTION

The present general inventive concept provides a method of reproducing a wide stereo sound by widening a stereo sound stage output by an audio reproducing apparatus using only speakers of two channels that are disposed close to each other.

The present general inventive concept also provides an apparatus to reproduce a wide stereo sound according to the above-described method.

Additional aspects and advantages of the present general inventive concept will be set forth in part in the description which follows and, in part, will be obvious from the description, or may be learned by practice of the general inventive concept.

The foregoing and/or other aspects and advantages of the present general inventive concept may be achieved by providing a method of reproducing a stereo sound in an audio reproducing apparatus, the method including a widening filtering operation and a direct filtering operation. In the widening filtering operation, virtual sound sources corresponding to arbitrary locations are formed from a stereo-channel audio signal using head related transfer functions measured at predetermined locations, and crosstalk is cancelled from the virtual sound sources using filter coefficients in which the head related transfer functions are reflected. In the direct filtering operation, signal characteristics of the stereo-channel audio signal are adjusted based on the crosstalk-cancelled virtual sound sources.

The foregoing and/or other aspects and advantages of the present general inventive concept may also be achieved by providing a method of reproducing a stereo sound in an audio reproducing apparatus, the method comprising a stereo-channel audio signal receiving operation of receiving a stereo-channel audio signal, and a panorama filtering operation. In the panorama filtering operation, virtual sound sources are formed from the stereo-channel audio signal, crosstalk is cancelled from the virtual sound sources, and signal characteristics of the input stereo-channel audio signal are adjusted based on the crosstalk-cancelled virtual sound sources. The adjusting of the signal characteristics of the input stereo-channel audio signal may be expressed as the following equation:

$$y_L = P_{11}(z)L + P_{12}(z)R$$

$$y_R = P_{21}(z)L + P_{22}(z)R,$$

wherein L and R denote left and right input signals of two channels, respectively, and $Y_L$ and $Y_R$ denote left and right output signals, respectively. Filter coefficients $P_{11}(z)$, $P_{12}(z)$, $P_{21}(z)$, and $P_{22}(z)$ may be calculated using the following equation:

$$\begin{bmatrix} P_{11}(z) & P_{12}(z) \\ P_{21}(z) & P_{22}(z) \end{bmatrix} = \begin{bmatrix} W_{11}(z) + D(z) & W_{12}(z) \\ W_{21}(z) & W_{21}(z) + D(z) \end{bmatrix}$$

wherein W(z) is expressed in the following equation:

$$\begin{bmatrix} W_{11}(z) & W_{12}(z) \\ W_{21}(z) & W_{22}(z) \end{bmatrix} = \begin{bmatrix} C_{11}(z) & C_{12}(z) \\ C_{21}(z) & C_{22}(z) \end{bmatrix} \begin{bmatrix} L_L(z) & R_L(z) \\ L_R(z) & R_R(z) \end{bmatrix}$$

and D(z) denotes a filter coefficient having a delay time and an amplitude of the stereo-channel audio signal.

The foregoing and/or other aspects and advantages of the present general inventive concept may also be achieved by providing an apparatus to reproduce a stereo sound, the apparatus including a binaural synthesis portion, a crosstalk canceller, and direct filters. The binaural synthesis portion forms virtual sound sources corresponding to arbitrary locations from a stereo-channel audio signal using head related transfer functions measured at predetermined locations. The crosstalk canceller cancels crosstalk from the virtual sound sources formed by the binaural synthesis portion, using filter coefficients based on information about angles at which actual speakers are disposed. The direct filters adjust a signal size of and a time delay of the stereo-channel audio signal based on the crosstalk-cancelled virtual sound sources using filter coefficients of the direct filters.

BRIEF DESCRIPTION OF THE DRAWINGS

These and/or other aspects and advantages of the present general inventive concept will become apparent and more readily appreciated from the following description of the embodiments, taken in conjunction with the accompanying drawings of which.

DETAILED DESCRIPTION OF THE PREFERRED EMBODIMENTS

Figure 1:
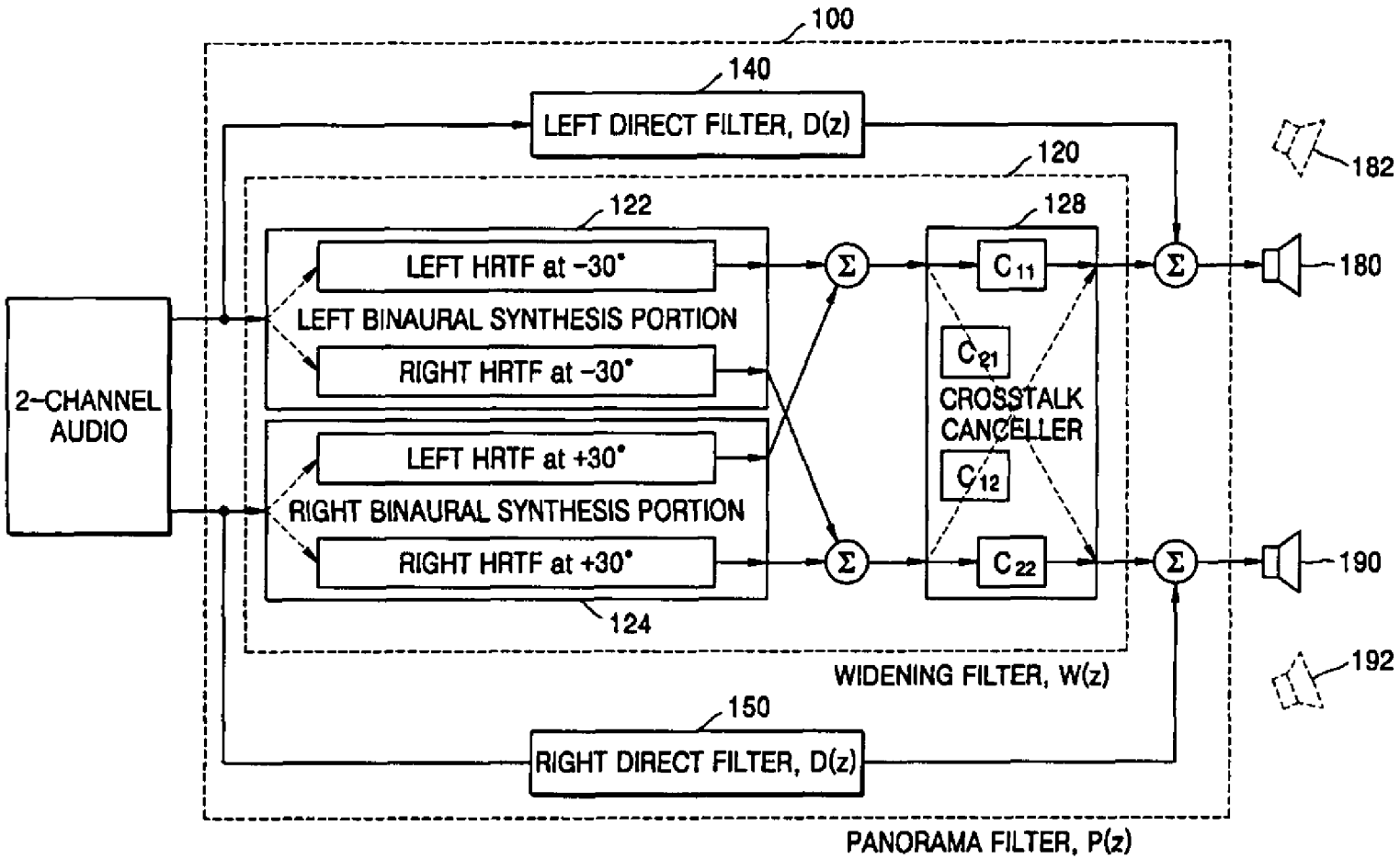
FIG. 1 is a block diagram illustrating an apparatus to reproduce a wide stereo sound, according to an embodiment of the present general inventive concept.

Reference will now be made in detail to the embodiments of the present general inventive concept, examples of which are illustrated in the accompanying drawings, wherein like reference numerals refer to the like elements throughout. The embodiments are described below in order to explain the present general inventive concept while referring to the figures.

FIG. 1 is a block diagram illustrating an apparatus to reproduce a wide stereo sound, according to an embodiment of the present general inventive concept. Referring to FIG. 1, the apparatus includes a widening filter 120 and left and right direct filters 140 and 150. The widening filter 120 is formed by convolving left and right binaural synthesis portions 122 and 124 and a crosstalk canceller 128 together. A panorama filter 100 is formed by convolving the widening filter 120 with the left and right direct filters 140 and 150.

The left and right binaural synthesis portions 122 and 124 produce virtual sound sources from a 2-channel audio signal based on head related transfer functions (HRTFs) measured at predetermined locations (angles) with respect to a sound source. In other words, the left and right binaural synthesis portions 122 and 124 render virtual speakers 182 and 192 symmetrically disposed in front of a listener, using the HRTFs. A left-channel audio signal of the 2-channel audio signal is convolved with HRTFs measured at −30 degrees. Likewise, a right-channel audio signal of the 2-channel audio signal is convolved with HRTFs measured at +30 degrees. Hence, an audio signal convolved with the HRTF for the left ear at −30 degrees and an audio signal convolved with the HRTF for the left ear at +30 degrees are summed to form a left virtual audio signal corresponding to a left virtual speaker 182. An audio signal convolved with the HRTF for the right ear at −30 degrees and an audio signal convolved with the HRTF for the right ear at +30 degrees are summed to form a right virtual audio signal corresponding to a right virtual speaker 192.

The crosstalk canceller 128 cancels crosstalk between the left and right virtual audio signals formed by the left and right binaural synthesis portions 122 and 124, based on filter coefficients in which the HRTFs are reflected. In other words, the crosstalk canceller 128 cancels the crosstalk between the left and right virtual audio signals so that the listener cannot hear the left virtual audio signal corresponding to the left virtual speaker 182 through the right ear and cannot hear the right virtual audio signal corresponding to the right virtual speaker 192 through the left ear.

The left and right direct filters 140 and 150 adjust a level of and an output timing of the 2-channel audio signal with respect to the left and right virtual audio signals of which the crosstalk has been canceled by the crosstalk canceller 128. The left and right direct filters 140 and 150 can filter an input stereo sound and adjust an output timing of and a signal level of a sound to be output through actual speakers 180 and 190 with respect to a sound (left and right virtual audio signals) corresponding to the virtual speakers 182 and 192 to thereby produce a natural sound.

The 2-channel audio signal filtered by the left and right direct filters 140 and 150 and the left and right virtual audio signals filtered by the widening filter 120 are summed and output to left and right actual speakers 180 and 190. Thus, the left and right actual speakers 180 and 190 output the 2-channel audio signal adjusted by the left and right direct filters 140 and 150 and the left and right virtual audio signals so that the listener hears the adjusted 2 channel audio signal from the left and right actual speakers 180 and 190, and the listener hears the left and right virtual audio signals from the left and right virtual speakers 182 and 192 although outputs (left and right audio signals of the 2-channel audio signal) of the left and right direct filters 140 and 150 and the left and right virtual audio signals of the widening filter 120 are output through the left and right actual speakers 180 and 190, respectively.

Figure 2:
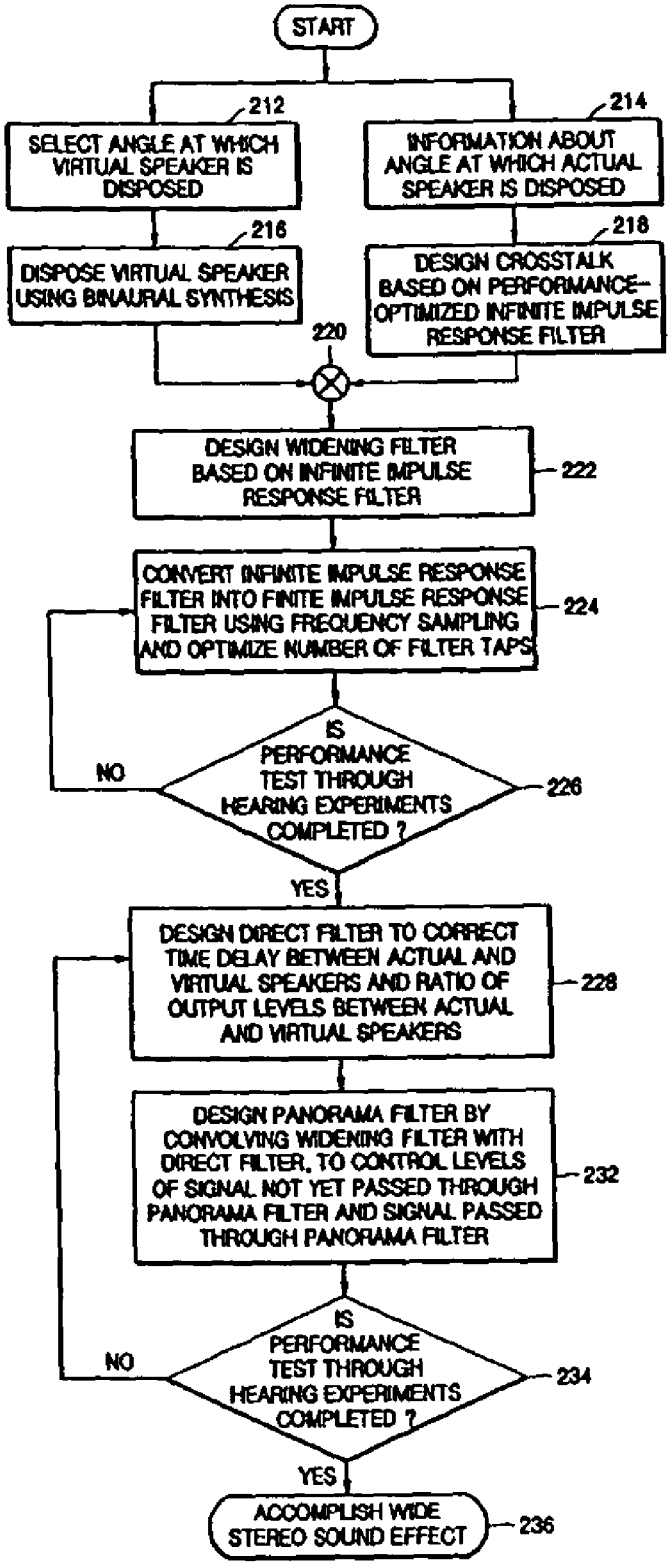
FIG. 2 is a flowchart illustrating a method of implementing the apparatus of FIG. 1.

FIG. 2 is a flowchart illustrating a method of implementing the apparatus of FIG. 1. An acoustic transfer function between a speaker and an eardrum is referred to as an HRTF The HRTF contains information representing characteristics of a space into which a sound is transferred, including a difference between timings when sound wave signals reach the right and left ears, a difference between levels of the sound wave signals for the right and left ears, and shapes of the right and left pinnas. Particularly, the HRTF can include information about the pinnas that critically affect localizations of upper and lower sound images. The information about the pinnas can be obtained through measurements because modeling the pinnas is not easy.

Referring to FIG. 2, at operation 212, angles at which the virtual speakers 182 and 192 are disposed are selected. At operation 216, the virtual speakers 182 and 192 are disposed based on binaural synthesis. The virtual sound sources can be formed at arbitrary locations by the use of an HRTF database measured at predetermined locations (angles) with respect to the speakers 180 and 190 and/or the virtual speakers 182 and 192. For example, if an HRTF measured at 30 degrees and an actual sound source are convolved, a sense of a virtual sound source at 30 degrees can be obtained. 2N virtual speakers are symmetrically disposed in front of a listener to widen a stereo sound stage. Right- and left-channel signals of a stereo sound pass through N virtual speakers located on the right side of the listener and N virtual speakers located on the left side of the listener, respectively.

Figure 3:
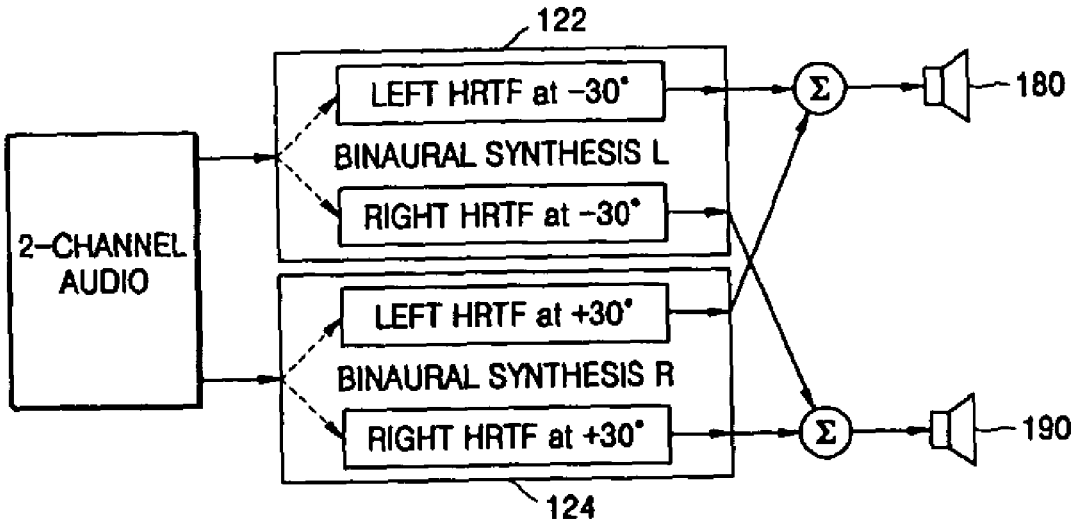
FIG. 3 is a detailed block diagram illustrating binaural synthesis portions of the apparatus of FIG. 1.

As illustrated in FIG. 3, a total of four HRTFs, including the two HRTFs between the left virtual speaker 182 and each of the right and left ears of the listener and the two HRTFs between the right virtual speaker 192 and each of the right and left ears, can be required to arrange the two virtual speakers 182 and 192. Accordingly, 4N HRTFs are required to arrange 2N virtual speakers. Since the 4N HRTFs can be represented as a sum of 2×2 square matrixes, when the sum is calculated using Equation 1, only a total of 4 HRTFs are required. Thus, an amount of calculation is drastically reduced. Equation 1 is:

$$\begin{bmatrix} L_L(z) & R_L(z) \\ L_R(z) & R_R(z) \end{bmatrix} = \begin{bmatrix} \sum_{i=1}^{N} L_{Li}(z) & \sum_{i=1}^{N} R_{Li}(z) \\ \sum_{i=1}^{N} L_{Ri}(z) & \sum_{i=1}^{N} R_{Ri}(z) \end{bmatrix} \quad (1)$$

wherein $L_{Li}(z)$ denotes an HRTF between an i-th left virtual speaker and the left ear, $R_{Li}(Z)$ denotes an HRTF between an i-th right virtual speaker and the left ear, $L_{Ri}(Z)$ denotes an HRTF between the i-th left virtual speaker and the right ear, and $R_{Ri}(z)$ denotes an HRTF between the i-th right virtual speaker and the right ear.

Figure 4:
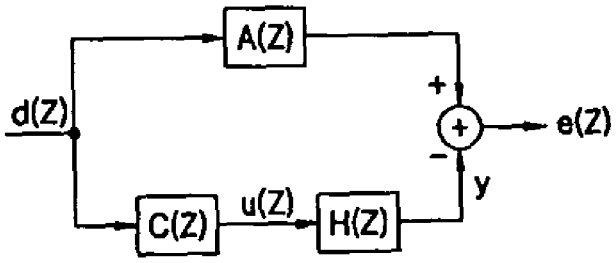
FIG. 4 is a detailed block diagram illustrating a crosstalk canceller of the apparatus of FIG. 1.

At operation 214, information regarding angles at which the actual speakers 180 and 190 are disposed is determined. At operation 218, the crosstalk canceller 128 based on an infinite impulse response (IIR) filter having an optimized performance is designed according to the information regarding the angles at which the actual speakers 180 and 190 are disposed. The crosstalk canceller 128 is used to prevent a stereo sound effect from being degraded due to generation of crosstalk between the two actual speakers 180 and 190 and the two ears of the listener upon sound reproduction through only the two actual speakers 180 and 190. FIG. 4 is a detailed block diagram of the crosstalk canceller 128. Referring to FIG. 4, d(z) denotes a binaural-synthesized signal, u(z) denotes an output of a speaker, and e(z) denotes an error to be minimized. Reference character H(z) denotes a transfer function matrix (e.g., a 2×2 square matrix) between two speakers and two ears of a listener, and reference character C(z) denotes a crosstalk-cancellation matrix designed to be inverse to the transfer function matrix H(z). Reference numeral A(z) denotes a pure delay filter matrix to satisfy causality. Since the transfer function matrix H(z) can have a shape of a finite impulse response (FIR) filter, the crosstalk-cancellation matrix C(z) can have a shape of an IIR filter because the crosstalk-cancellation matrix C(z) is inverse to the transfer function matrix H(z). However, because of stability, the crosstalk-cancellation matrix C(z) can be approximated to an FIR filter. In this case, despite the fact that the crosstalk cancellation matrix C(z) can be well approximated to a FIR filter of a high order, the crosstalk cancellation matrix C(z) can be approximated to an FIR filter of a low order, as well, because of hardware problems. Hence, obtaining an exact crosstalk cancellation matrix C(z) is difficult. The wide stereo sound reproducing apparatus of FIG. 1 can include a portion to convert an IIR filter into an FIR filter and optimize the order of the filter, such that an optimized IIR filter can be applied to a crosstalk canceller. The crosstalk cancellation matrix C(z) designed based on IIR filter coefficients is divided into a stable portion and an unstable portion. The stable portion is formed of the IIR filter, and the unstable portion is formed of the FIR filter. The two portions are convolved to obtain a single stable IIR filter.

The number of and the locations of the virtual speakers 182 and 192 that affect binaural synthesis are predetermined, and the locations of the actual speakers 180 and 190 that affect the crosstalk canceller 128 are also predetermined. Hence, at operations 220 and 222, the binaural synthesis and the crosstalk canceller 128 are convolved to design the widening filter 120 based on the IIR filter. If 2N virtual speakers are arranged, a binaural synthesis is a 2×2 square matrix, and the crosstalk cancellation matrix C(z) is also a 2×2 square matrix. Hence, the widening filter is a 2×2 square matrix corresponding to a product of the two 2×2 square matrixes. The widening filter is obtained by Equation 2:

$$\begin{bmatrix} W_{11}(z) & W_{12}(z) \\ W_{21}(z) & W_{22}(z) \end{bmatrix} = \begin{bmatrix} C_{11}(z) & C_{12}(z) \\ C_{21}(z) & C_{22}(z) \end{bmatrix} \begin{bmatrix} L_L(z) & R_L(z) \\ L_R(z) & R_R(z) \end{bmatrix} \quad (2)$$

wherein W(z) denotes a widening filter matrix, C(z) denotes the crosstalk cancellation matrix, $L_L(z)$ denotes the HRTF between the left virtual speaker 182 and the left ear, $R_L(z)$ denotes the HRTF between the right virtual speaker 192 and the left ear, $L_R(z)$ denotes the HRTF between the left virtual speaker 182 and the right ear, and $R_R(z)$ denotes the HRTF between the right virtual speaker 192 and the right ear.

However, since the crosstalk canceller 128 is optimized based on the IIR filter, the order of the widening filter 120 can be increased like the crosstalk canceller filter 128. Thus, there can be difficulty in implementing the widening filter 120 in real time. Accordingly, at operation 224, the widening filter 120 converts the IIR filter into the FIR filter using frequency sampling to minimize the order of the widening filter. At this time, a frequency interval in a frequency band is adjusted using the frequency sampling to thereby adjust the order of the FIR filter. A minimum filter order that does not degrade a performance of a filter is determined through a hearing test.

Figure 5:
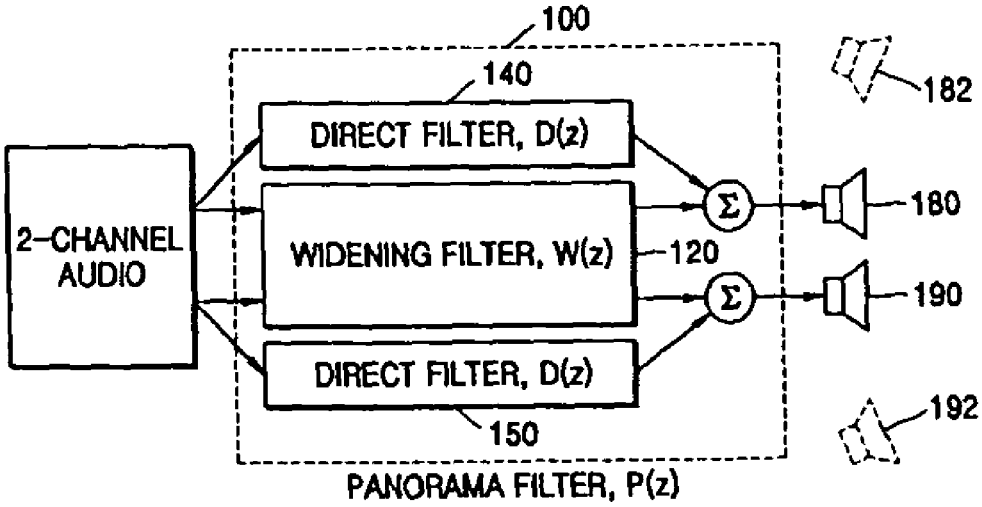
FIG. 5 is a block diagram illustrating a matrix relationship between a pair of direct filters and a widening filter of the apparatus of FIG. 1.

Thereafter, at operation 226, it is determined whether a performance test of the widening filter 120 through hearing experiments has been completed. When the performance test is completed, the direct filters 140 and 150 to correct a time delay and an output level difference between the actual speakers 180 and 190 and the virtual speakers 182 and 192 are designed, at operation 228. In other words, when the stereo sound passes through the widening filter 120 and is then reproduced through only the two actual speakers 180 and 190, the stereo sound seems to be reproduced through virtual speakers 182 and 192 arranged widely in front of the listener. In this case, although the stereo sound is widened by the widely arranged virtual speakers 182 and 192, the sound seems empty at the center of the front side of the listener where no virtual speakers 182 and 192 are disposed. Hence, the listener hears an unnatural sound having a deteriorated tone. To solve this problem, the direct filters 140 and 150 are designed so that the actual speakers 180 and 190 can also output sounds. The direct filters 140 and 150 adjust the sizes of outputs of the actual and virtual speakers 180, 190, 182 and 192 and a time delay between the actual and virtual speakers 180, 190, 182, and 192. The time delay by the direct filters 140 and 150 is matched with a pre-designed time delay by the widening filter 120 to prevent a deterioration of the tone of the sound. The direct filters 140 and 150 determine a ratio of output levels of the actual speakers 180 and 190 to output levels of the virtual speakers 182 and 192. Thus, the direct filters can adjust a degree to which the stereo sound is divided. If the magnitude of each of the direct filters 140 and 150 is close to 0, the sound is reproduced through only the virtual speakers, and accordingly the sound from the center of the front side of the listener is empty although a stereo sound stage is widened. If the magnitude of each of the direct filters 140 and 150 is extremely large, the sound is reproduced through only the actual speakers 180 and 190, and accordingly a wide stereo effect is not obtained. Thus, the magnitudes of the direct filters 140 and 150 must be determined through a number of hearing tests. FIG. 5 is a block diagram illustrating a relationship between a matrix D(z) of each of the direct filters 140 and 150 and the matrix W(z) of the widening filter 120. The widening filter 120 forms the left and right virtual audio signals from the input stereo sound and outputs the left and right virtual audio signals corresponding to the virtual speakers 182 and 192. The direct filters 140 and 150 adjust signal characteristics of the input stereo sound based on the left and right virtual audi signals and outputs an adjusted input stereo sound to the actual speakers 180 and 190.

At operation 232, a panorama filter 100 is designed by convolving the widening filter 120 and the direct filters 140 and 150. In other words, a parameter filter matrix P(z), which is a single filter, is obtained by adding the widening filter matrix W(z) and the direct filter matrix D(z). The panorama filter matrix P(z) is defined as in Equation 3:

$$P(z)=W(z)+D(z) \tag{3}$$

Each element of the matrix P(z) is calculated using Equation 4:

$$\begin{bmatrix} P_{11}(z) & P_{12}(z) \\ P_{21}(z) & P_{22}(z) \end{bmatrix} = \begin{bmatrix} W_{11}(z)+D(z) & W_{12}(z) \\ W_{21}(z) & W_{21}(z)+D(z) \end{bmatrix} \tag{4}$$

wherein each element of the matrixes P(z) and W(z) is an FIR filter coefficient, and D(z) denotes a filter coefficient having a pure delay time and a pure size.

Figure 6:
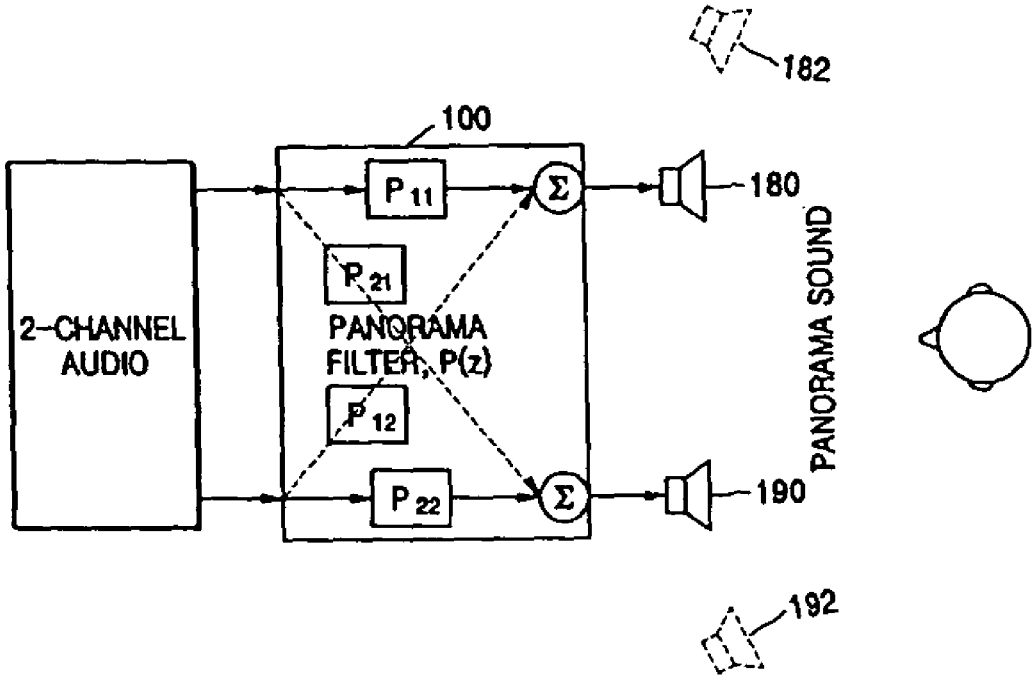
FIG. 6 is a conceptual diagram illustrating a panorama filter of the apparatus of FIG. 1.

FIG. 6 illustrates the panorama filter 100 to reproduce the wide stereo sound. Referring to FIG. 6, since the stereo sound is a 2×2 vector, when the stereo sound passes through the panorama filter 100 in the shape of a 2×2 square matrix, a 2-channel widened stereo sound is output. The amplitude of a signal not yet passed through the panorama filter 100 and a signal passed through the panorama filter 100 can be adjusted through various hearing tests to obtain the greatest sound quality when the wide stereo sound is played. The values of the final output signals are obtained using Equation 5:

$$y_L=P_{11}(z)L+P_{12}(z)R$$

$$y_R=P_{21}(z)L+P_{22}(z)R \tag{5}$$

wherein L and R denote left and right input signals of two channels, respectively, and $y_L$ and $y_R$ denote left and right output signals of two channels, respectively.

At operation 234, it is determined whether a performance test for the panorama filter through the hearing experiments has been completed. When the performance test is completed, the wide stereo sound is reproduced, in operation 236. Consequently, as illustrated in FIG. 6, a listener can hear a wide stereo sound through the actual speakers 180 and 190 and the virtual speakers 182 and 192.

Figure 7:
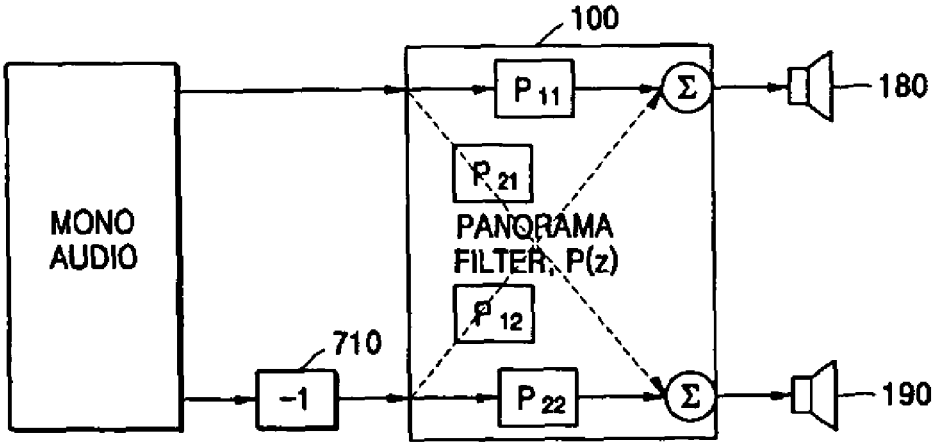
FIG. 7 is a block diagram illustrating a production of a wide stereo sound from a mono sound according to an embodiment of the present general inventive concept.

FIG. 7 is a block diagram of an apparatus to reproduce a wide stereo sound from a mono sound, according to an embodiment of the present general inventive concept.

TV broadcasting stations generally output mono-sounds. The panorama filter matrix P(z), of FIG. 6 has a symmetrical structure as shown in Equation 4. Hence, when the mono-sound passes through the panorama filter matrix P(z), identical signals are output to the actual speakers 180 and 190. In other words, when the mono-sound is input to the panorama filter 100 of FIG. 6, a stereo sound effect is not generated. Referring to FIG. 7, the mono audio signal input through a single channel is converted into a 2-channel audio signal while passing through a phase inverter 710, which inverts a phase of the input mono signal by 180 degrees. The input mono audio signal and a mono audio signal having a 180°-converted phase are input to a panorama filter 100, which is pre-designed with an optimal filter. The stereo sound produced from the mono sound can be expressed as in Equation 6:

$$L=M,\ R=-M \tag{6}$$

wherein L denotes a left channel, R denotes a right channel, and M denotes the mono sound.

Figure 8:
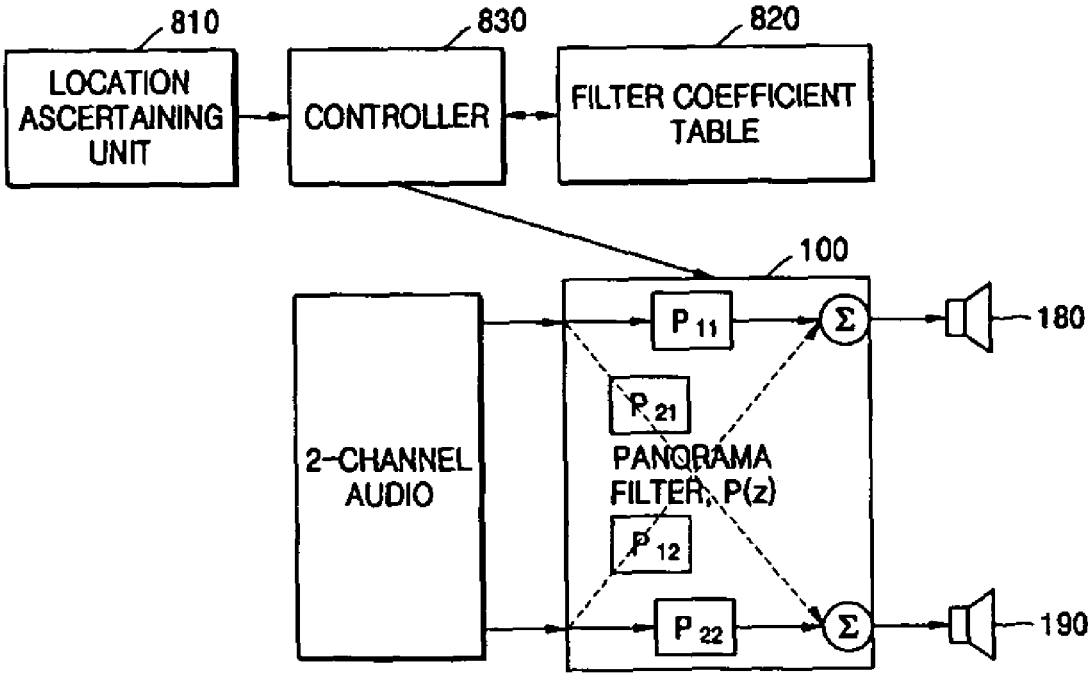
FIG. 8 is a block diagram illustrating a production of an adaptive wide stereo sound according to an embodiment of the present general inventive concept.

FIG. 8 is a block diagram of a system to produce an adaptive wide stereo sound, according to an embodiment of the present general inventive concept.

When the wide stereo technology of FIG. 1 is used, the listener feels an optimal performance when the user is at a sweet spot. Since the location of the listener is generally not restricted, an optimal wide stereo performance should be obtained no matter where the listener is located. Thus, in the system of FIG. 8, a location of the listener is ascertained in real time, and the wide stereo sound is reproduced using filter coefficients pre-designed according to the ascertained location of the listener.

Referring to FIG. 8, first, coefficients $P_{11}$, $P_{12}$, $P_{21}$, and $P_{22}$ of the optimized panorama filter 100 corresponding to various locations of a listener are calculated. The panorama filter coefficients are stored in a filter coefficient table 820, which is a lookup table. A location ascertaining unit 810 ascertains a location of the listener using an iris recognition technology. The location ascertaining unit 810 is not limited to using the iris recognition technology, but may variously determine the location of the user. A controller 830 reads the filter coefficients $P_{11}$, $P_{12}$, $P_{21}$, and $P_{22}$ corresponding to the listener's location ascertained by the location ascertaining unit 810 from the filter coefficient table 820 and outputs the filter coefficients $P_{11}$, $P_{12}$, $P_{21}$, and $P_{22}$ to the panorama filter 100. The panorama filter 100 generates the stereo sound corresponding to the input 2-channel audio signal using the received filter coefficients $P_{11}$, $P_{12}$, $P_{21}$, and $P_{22}$. Consequently, the system of FIG. 8 can provide the stereo sound effect adaptive to each location of the listener.

In a wide stereo reproducing apparatus and method according to the present general inventive concept, a widening filter is obtained by convolving a binaural synthesis portion with a crosstalk canceller to thereby reduce calculations. Also, sounds are output not only through virtual speakers using HRTFs but also through actual speakers. A panorama filter is designed to be a matrix in which the widening filter coefficients for the virtual speakers and direct filter coefficients for the actual speakers are convolved. Each of the filters is designed to have an optimal performance, and the optimal performance is maintained through various hearing tests. Due to the use of frequency sampling, each of the filter coefficients has an optimal performance and minimizes the amount of calculation. Thus, when the wide stereo reproducing apparatus and method according to the present general inventive concept are applied to products having two closely arranged speakers, such as, TVs, PCs, Note PCs, PDAs, cellular phones, and the like, a stereo sound stage is widened, so listeners can feel an enhanced stereo sound effect without need to purchasing extra speaker sets.

The general inventive concept can also be embodied as computer readable codes on a computer readable recording medium. The computer readable recording medium can be any data storage device that can store data which can be thereafter read by a computer system. Examples of the computer readable recording medium include read-only memory (ROM), random-access memory (RAM), CD-ROMs, magnetic tapes, floppy disks, optical data storage devices, and carrier waves (such as data transmission through the Internet). The computer readable recording medium can also be distributed over network coupled computer systems so that the computer readable code is stored and executed in a distributed fashion.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

What is claimed is:

1. A method of reproducing a stereo sound in an audio reproducing apparatus, the method comprising:

forming virtual sound sources corresponding to arbitrary locations with a binaural synthesis apparatus from a stereo-channel audio signal using head related transfer functions measured at predetermined locations, and canceling crosstalk with a crosstalk canceling unit between the virtual sound sources using filter coefficients in which the head related transfer functions are reflected;

widening a stereo sound stage by convolving a binaural synthesis coefficient for the forming virtual sound sources with a crosstalk canceling coefficient for the canceling crosstalk; and adjusting signal characteristics of the stereo-channel audio signal based on the crosstalk-cancelled virtual sound sources in a direct filtering operation with at least one direct filter to correct a time delay and an output level difference between actual speakers and virtual speakers.

2. The method of claim 1, wherein the forming of the virtual sound sources comprises convolving the head related transfer functions with the stereo-channel audio signal to form the virtual sound sources in a binaural synthesis operation, and the canceling of the crosstalk comprises canceling the crosstalk in a crosstalk canceling operation.

3. The method of claim 2, wherein the convolving the head related transfer functions with the stereo channel audio signal comprises forming the virtual sound sources using coefficients calculated using the following equation:

$$\begin{bmatrix} L_L(z) & R_L(z) \\ L_R(z) & L_R(z) \end{bmatrix} = \begin{bmatrix} \sum_{i=1}^{N} L_{Li}(z) & \sum_{i=1}^{N} R_{Li}(z) \\ \sum_{i=1}^{N} L_{Ri}(z) & \sum_{i=1}^{N} R_{Ri}(z) \end{bmatrix}$$

where $L_{Li}(z)$ denotes a head related transfer function between an i-th left virtual speaker and a left ear of a listener, $R_{Li}(r)$ denotes a head related transfer function between an i-th right virtual speaker and the left ear, $L_{Ri}(z)$ denotes a head related transfer function between the i-th left virtual speaker and a right ear of the listener, and $R_{Ri}(z)$ denotes a head related transfer function between the i-th right virtual speaker and the right ear.

4. The method of claim 2, wherein a matrix of the filter coefficients for the crosstalk cancellation operation is inverse to a matrix of the head related transfer functions between two virtual speakers and right and left ears of a listener.

5. The method of claim 1, wherein the forming of the virtual sound sources comprise forming the virtual sound sources using a widening filter having coefficients calculated using the following equation:

$$\begin{bmatrix} W_{11}(z) & W_{12}(z) \\ W_{21}(z) & W_{22}(z) \end{bmatrix} = \begin{bmatrix} C_{11}(z) & C_{12}(z) \\ C_{21}(z) & C_{22}(z) \end{bmatrix} \begin{bmatrix} L_L(z) & R_L(z) \\ L_R(z) & R_R(z) \end{bmatrix}$$

where W(z) denotes a widening filter coefficient, C(z) denotes a crosstalk canceller coefficient, $L_L(z)$ denotes an HRTF between a left virtual speaker and the left ear, $R_L(z)$denotes an HRTF between a right virtual speaker and the left ear, $L_R(z)$denotes an HRTF between the left virtual speaker and the right ear, and $R_R(z)$ denotes an HRTF between the right virtual speaker and the right ear.

6. The method of claim 1, wherein the forming of the virtual sound sources comprises converting high-order infinite impulse response filter coefficients into low-order finite impulse response filter coefficients using frequency sampling.

7. The method of claim 1, wherein, the signal characteristics comprise a signal magnitude and a time delay.

8. The method of claim 1, further comprising:

forming a 2-channel stereo sound from an input mono sound by converting a phase of the input mono sound by 180 degrees.

9. A method of reproducing a stereo sound in an audio reproducing apparatus, the method comprising: receiving a stereo-channel audio signal; and forming virtual sound sources from the stereo-channel audio signal with a binaural synthesis apparatus, canceling crosstalk from the virtual sound sources with a crosstalk canceling unit, and adjusting signal characteristics of the input stereo-channel audio signal based on the crosstalk-cancelled virtual sound sources in a panorama filter operation including convolution using at least one filter, wherein: the virtual sound sources are expressed as the following equation:

$$yL = P_{11}(z)L + P_{12}(z)R$$

$$yR = P_{21}(z)L + P_{22}(z)R$$

where L and R denote left and right input signals of two channels, respectively, and YL and YR denote left and right output signals, respectively, and P11(z), P12(z), P21(z), and P22(z), and the filter coefficients are calculated using the following equation:

$$[P_{11}(z) \quad P_{12}(z)] = [W_{11}(z) + D(z) \quad W_{12}(z)]$$

$$[P_{21}(z) \quad P_{22}(z)] = [W_{21}(z) \quad W_{21}(z) + D(z)]$$

where W(z) is expressed in the following equation:

$$[W_{11}(z)\quad W_{12}(z)] = [C_{11}(z)\quad C_{12}(z)]\quad [L_L(z)\quad R_L(z)]$$

$$[W_{21}(z)\quad W_{22}(z)] = [C_{21}(z)\quad C_{22}(z)]\quad [L_R(z)\quad R_R(z)]$$

where W(z) denotes a widening filter coefficient, C(z) denotes a crosstalk canceller coefficient, LL(z) denotes an HRTF between a left virtual speaker and the left ear, RL(z) denotes an HRTF between a right virtual speaker and the left ear, LR(z) denotes an HRTF between the left virtual speaker and the right ear, RR(z) denotes an HRTF between the right virtual speaker and the right ear, and D(z) denotes a filter coefficient having a delay time and an amplitude of the stereo° channel audio signal.

10. The method of claim 9, wherein orders of the filter coefficients are adjusted by controlling a frequency interval in a frequency band.

11. The method of claim 9, further comprising:

calculating the filter coefficients for the panorama filtering operation according to a location of a listener;

detecting a location of the listener;

reading filter coefficients for the panorama filtering operation corresponding to a detected location of the listener; and producing a stereo sound from the stereo-channel audio signal using the read-out filter coefficients.

* * * * *